US005492062A

United States Patent [19]

Harris et al.

[11] Patent Number: 5,492,062

[45] Date of Patent: Feb. 20, 1996

[54] PRINTING CYLINDER POSITIONING DEVICE AND METHOD

[75] Inventors: Craig S. Harris, Durham; Glenn A. Guaraldi, Kingston; Bertrum S. Ramsay, Wolfeboro, all of N.H.

[73] Assignees: Heidelberg Druckmaschinen AG, Heidelberg, Germany; Heidelberg Harris Inc., Dover, N.H.

[21] Appl. No.: 436,161

[22] Filed: May 8, 1995

[51] Int. Cl.[6] ..... B41J 1/32

[52] U.S. Cl. ..... 101/486; 101/247; 101/248

[58] Field of Search ..... 101/485, 486, 101/247, 248, 181, 183, 216, 219

[56] References Cited

U.S. PATENT DOCUMENTS

| | | | |
|---|---|---|---|
| 4,109,574 | 8/1978 | Förster et al. | 101/247 |
| 4,350,093 | 9/1982 | Ishii | 101/248 |
| 4,428,288 | 1/1984 | Harper et al. | 101/248 |
| 4,437,403 | 3/1984 | Greiner | 101/248 |
| 4,527,788 | 7/1985 | Masuda | 101/248 |
| 5,127,324 | 7/1992 | Palmatier | 101/248 |
| 5,170,708 | 12/1992 | Di Lalla | 101/248 |
| 5,178,070 | 1/1993 | Zorn et al. | 101/486 |
| 5,263,413 | 11/1993 | Ikeguchi | 101/486 |
| 5,272,975 | 12/1993 | Dettinger et al. | 101/247 |
| 5,377,589 | 1/1995 | Krüger et al. | 101/248 |

*Primary Examiner*—Eugene H. Eickholt

*Attorney, Agent, or Firm*—Tarolli, Sundheim & Covell

[57] ABSTRACT

A device (10) and a method for positioning a rotatable printing cylinder (16) for a printing press (12). A drive (24) can rotate the cylinder (16) about a cylinder axis (52) at relatively high and low speeds. A sensor (68) is positioned adjacent to the cylinder (16) for detecting rotational positions of the cylinder (16) and providing a signal which varies in response to detected rotational positions of the cylinder (16). A sensor exciting target (66) has first and second edges (74 and 76) at first and second ends, respectively, of a sector of the cylinder (16). The sensor (68) is aligned with the first edge (74) at a first rotational position of the cylinder (16) and is aligned with the second edge (76) at a second rotational position of the cylinder (16). A controller (56) controls the drive (24) in response to the signal from the sensor (68) to rotate the cylinder (16) at the relatively high speed when the sensor (68) is not aligned with a point on the sector and until the cylinder (16) reaches the first rotational position, to rotate the cylinder (16) at the relatively low speed when the sensor (68) is aligned with a point on the sector and until the cylinder (16) is at the second rotational position, and to cease rotation of the cylinder (16) when the cylinder (16) is at the second rotational position.

20 Claims, 2 Drawing Sheets

PRINTING CYLINDER POSITIONING DEVICE AND METHOD

BACKGROUND OF THE INVENTION

The present invention relates to a device and a method for positioning a rotatable cylinder of a printing press.

An offset printing press has a plurality of rotatable cylinders including plate cylinders and blanket cylinders. Each of the plate and blanket cylinders carries a printing cover, which are a printing plate and a printing blanket, respectively. Each printing plate and printing blanket is wrapped around the respective cylinder. The ends of each printing plate and printing blanket are affixed to the respective cylinder.

Each printing plate has an image to be printed. The image is transferred from the printing plate to the associated printing blanket as the printing plate and the printing blanket are rotated against each other. The image is transferred to the material being printed, such as a web of paper, from the printing blanket as the web is moved past the rotating printing blanket.

In order to change the printing, the printing plate is replaced. Also, the printing blanket must periodically be replaced due to wear. Due to the construction of the printing press, only a limited work area is present to complete the replacement of the printing plate and/or the printing blanket. During a replacement operation of the printing plate and/or the printing blanket, the cylinders are rotatably driven to locate the cylinders in an access or index position for access to the ends of the printing plate and/or the printing blanket. In order to rotate the cylinders to the access position, the cylinders are driven by the same motor which drives the cylinders during the printing operation. If the cylinders are driven at a relatively high rate of speed, the cylinders may overrun the access position due to rotational inertia. If the cylinders are driven at a relatively low rate of speed, excessive time is wasted.

SUMMARY OF THE INVENTION

The present invention is a device and a method for positioning a rotatable printing cylinder for a printing press. The device includes a drive for rotating the cylinder about a cylinder axis at a relatively high speed and for rotating the cylinder about the cylinder axis at a relatively low speed. A sensor is positioned adjacent to the cylinder for detecting rotational positions of the cylinder and for providing a signal which varies in response to detected rotational positions of the cylinder. A sensor exciting target has first and second edges located at first and second ends, respectively, of a sector of the cylinder. The sensor is aligned with the first edge of the target and the first end of the sector at a first rotational position of the cylinder. The sensor is aligned with the second edge of the target and the second end of the sector at a second rotational position of the cylinder.

During operation, a controller controls the drive in response to the signal from the sensor. The drive is controlled to rotate the cylinder at the relatively high speed when the sensor is not aligned with a point on the sector and until the cylinder reaches the first rotational position. The drive is controlled to rotate the cylinder at the relatively low speed when the sensor is aligned with a point on the sector and until the cylinder is at the second rotational position. The drive is controlled to cease rotation of the cylinder when the cylinder is at the second rotational position.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENT

Figure 1:
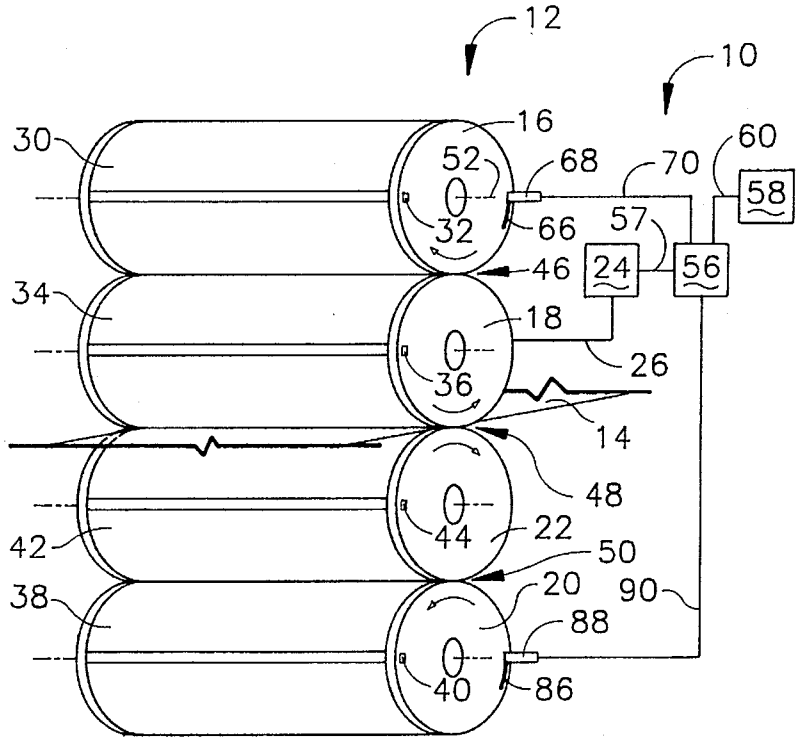
FIG. 1 is a schematic illustration of a printing press which has a cylinder positioning device according to the present invention.

A positioning device 10 constructed in accordance with the present invention is shown in a printing press 12 which is schematically illustrated in FIG. 1. The printing press 12, by way of example, is an offset lithographic printing unit for printing on opposite sides of a web 14. The printing press 12 includes an upper plate cylinder 16 and an upper blanket cylinder 18 above the web 14, and a lower plate cylinder 20 and a lower blanket cylinder 22 below the web 14. The cylinders 16–22 are supported for rotation at their opposite ends in a frame (not shown) which has a pair of side walls. The accessibility to the cylinders 16–22 by a press operator is limited by the frame and other structure of the printing press 12.

A motor 24 drives a gear train 26 which is connected to one of the cylinders 16–22, such as the upper blanket cylinder 18, to drive the cylinder. The cylinders 16–22 have intermeshing gear portions to cause synchronous rotation of the cylinders 16–22 about their respective axes as indicated by the arrows shown in FIG. 1 and as known in the art. The motor 24 and the gear train 26 can be constructed as known in the art.

The upper plate cylinder 16 carries a printing plate 30 which defines an image to be printed. The printing plate 30 is formed as a thin metal sheet, and is mounted on the upper plate cylinder 16 by wrapping the sheet around the upper plate cylinder 16. A locking mechanism 32 in the upper plate cylinder 16 holds the edges of the printing plate 30 and retains the printing plate 30 securely on the upper plate cylinder 16. The locking mechanism 32 may be any known locking device such as the printing plate clamp mechanism disclosed in U.S. Pat. No. 3,538,850 or the plate lock-up mechanism disclosed in U.S. Pat. No. 4,347,788.

The upper blanket cylinder 18 carries a printing blanket 34. The printing blanket 34 is mounted on the upper blanket cylinder 18 by wrapping the printing blanket 34 around the upper blanket cylinder 18. A locking mechanism 36 in the upper blanket cylinder 18 holds the edges of the printing blanket 34 and retains the printing blanket 34 securely on the upper blanket cylinder 18. Another printing plate 38 is similarly mounted on the lower printing plate cylinder 20 and is secured by a locking mechanism 40 and another printing blanket 42 is similarly mounted on the lower blanket cylinder 22 and is secured by a locking mechanism 44.

When the cylinders 16–22 are being rotated by the motor 24 and the gear train 26, ink is applied to both of the printing plates 30 and 38, to form images on the printing plates 30 and 38. The inked image on the upper printing plate 30 is transferred to the upper printing blanket 34 at a nip 46 between the upper plate cylinder 16 and the upper blanket cylinder 18. The upper printing blanket 34 subsequently transfers the inked image to the upper side surface of the web 14 at a nip 48 between the upper and lower blanket cylinders 18 and 22.

The lower printing plate 38 transfers its inked image to the lower printing blanket 42 at a nip 50 between the lower plate cylinder 20 and the lower blanket cylinder 22. The lower printing blanket 42 subsequently transfers the inked image to the lower side surface of the web 14 at the nip 48. The printing press 12 thus prints simultaneously on opposite sides of the web 14. Operation of the motor 24 to drive the cylinders 16–22 is controlled by a controller 56 via a line 57. An operation input 58 provides a control signal to the controller 56 via a line 60 such that the printing press 12 is operated to imprint the web 14 as known in the art.

The positioning device 10 rotates the cylinders 16–22 to an index (access) position in which the press operator can readily change a printing plate and/or a printing blanket. The positioning device 10 (FIG. 2) includes a target 66 mounted on an axial end of the upper plate cylinder 16 and a sensor 68 mounted on the support frame to extend adjacent to the axial end of the upper plate cylinder 16. The upper plate cylinder 16 is rotatable about its axis 52 relative to the sensor 68. The target 66 is moved past the sensor 68 as the upper plate cylinder 16 rotates. Alternatively, the target 66 can be mounted on a bearer fixed for rotation with the upper plate cylinder 16, with the sensor 68 mounted on the support frame to extend adjacent to the bearer. Also, alternatively, the target 66 and the sensor 68 could be associated with any of the other cylinders 18–22.

Figure 2:
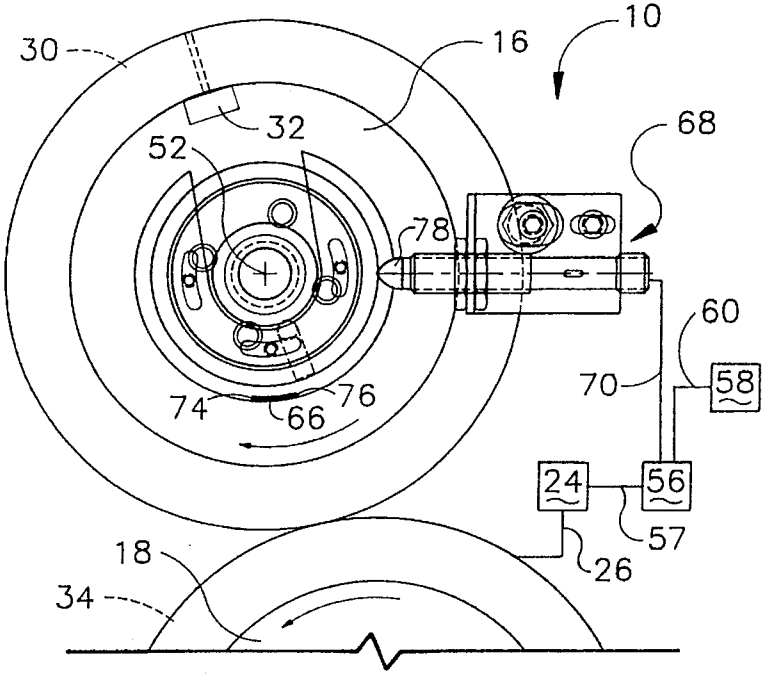
FIG. 2 is a partial end view of the printing press of FIG. 1, including schematic representations, and shows a cylinder in a first rotational position.
Figure 4:
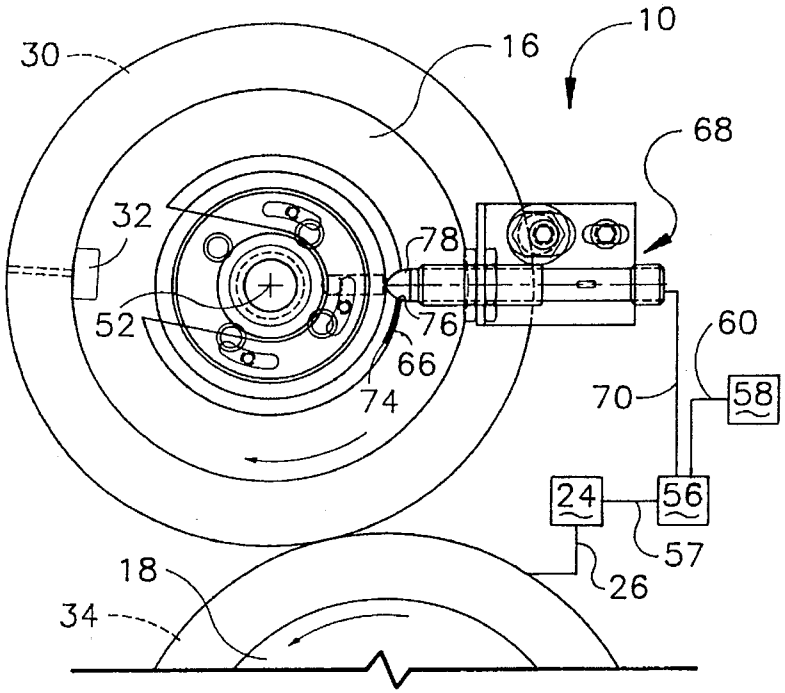
FIG. 4 is a view similar to FIG. 2 and shows the cylinder in a third rotational position.
Figure 3:
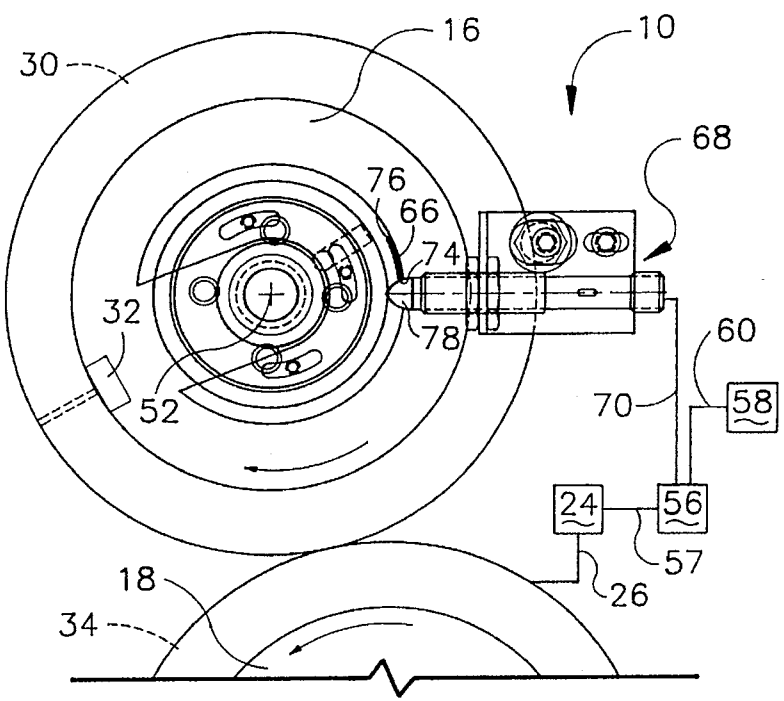
FIG. 3 is a view similar to FIG. 2 and shows the cylinder in a second rotational position.

In the preferred embodiment, the target 66 is a ferrous metal strip which extends in an arc along a sector of the axial end of the upper plate cylinder 16. The target 66 has a first edge 74 and a second edge 76 located at the ends of the sector. The target 66 is mounted such that during rotation of the upper plate cylinder 16 (clockwise, as shown in FIGS. 2–4) the first edge 74 is the leading edge of the target 66 which approaches the sensor 68. The target 66 has a predetermined length along its arc between the first and second edges 74 and 76. As shown in the Figures, the sector of the upper plate cylinder 16 along which the target 66 extends has an arc length of approximately 20°. However, any suitable arc length can be used.

In the preferred embodiment, the sensor 68 is a proximity sensor which is activated or excited by the presence of the target 66 being aligned with a sensor field 78 of the sensor 68. Specifically, the proximity sensor detects the magnetic characteristics of the target 66. Of course, any other characteristic could be detected. Alternatively, the target may be an optically reflective strip and the sensor 68 may be an optical sensor. The sensor 68 provides an electrical signal, such as a voltage signal, to the controller 56 via a line 70 to control operation of the motor 24 during a positioning maneuver. During rotation of the upper plate cylinder 16 in the positioning maneuver, the signal provided by the sensor 68 has a first, unexcited level when the sensor field 78 is not aligned with any segment of the target 66 (FIG. 2). In other words, the sensor field 78 is not aligned with any point on the sector of the upper plate cylinder 16.

The signal from the sensor 68 steps up from the first level to a second, excited level as the first edge 74 of the target 66 is rotated into alignment with the sensor field 78. The signal from the sensor 68 remains at the second, excited level as the upper plate cylinder 16 is rotated and the sensor field 78 is aligned with a portion of the target 66. In other words, the sensor field 78 is aligned with some point on the sector of the upper plate cylinder 16. As the upper plate cylinder 16 is rotated such that the second edge 76 of the target 66 is aligned with the sensor field 78, the signal will drop, or step down from the second, excited level to the first, unexcited level.

The target 66 is located on the axial end of the upper plate cylinder 16 such that the second edge 76 is aligned with the sensor field 78 when the upper plate cylinder 16 and/or the upper blanket cylinder 18 are located in their index position. In the index position, the press operator has access to the locking mechanisms 32 and 40 and the edges of the printing plate 30 and the printing blanket 34 to effect a change of the printing plate 30 and/or the printing blanket 34. The index position may also permit access to service the lower plate cylinder 20 and the lower blanket cylinder 22, dependent upon the construction of the printing press 12.

During the positioning maneuver, the signal provided by the sensor 68 to the controller 56 is utilized by the controller 56 to operate the motor 24 to drive the cylinders 16–22 through respective partial revolutions until the target 66 passes the sensor field 78 and cylinders 16 and 18 are in the index position. The motor 24 is controlled to drive the cylinders 16–22 at relatively high and low speeds. When the signal from the sensor 68 is at the first, unexcited level, the cylinders 16–22 are driven at the relatively high, efficient speed.

Preferably, the relatively high speed is equivalent to a linear speed of 15 feet per minute at the nip 48. The relatively high speed expedites the positioning maneuver by quickly accomplishing the bulk of the positioning rotation. The duration of the rotation at the relatively high speed is related to the rotational distance between an initial position of the upper plate cylinder 16 and the position at which the sensor field 78 aligns with the first edge 74.

As the sensor field 78 becomes aligned with the first edge 74 of the target 66, the signal from the sensor 68 steps up to the second, excited level and the speed of the motor 24 is changed by the controller 56. When the signal from the sensor 68 is at the second, excited level, the cylinder 16–22 are driven at the relatively low, precise speed. The relatively low speed is preferably equivalent to a linear speed of one foot per minute at the nip 48. The relatively low speed alleviates excessive rotational inertia in order to avoid rotational overrun of the index position. The duration of the rotation at the relatively low speed is related to the length of the target 66. As the sensor field 78 becomes aligned with the second edge 76 of the target 66, the signal from the sensor 68 steps down to the first, unexcited state and the motor 24 is stopped.

During a normal printing operation, the sensor 68 is either deactivated or its signal is ignored by the controller 56. Moreover, the cylinders 16–22 are driven at their normal printing speed. A printing plate 30 and/or a printing blanket 34 servicing operation method is initiated with the printing press 12 being idle, and the cylinders 16–22 being stationary. The upper plate cylinder 16 is located at an arbitrary rotational position (as shown in FIG. 2) due to previous rotational inertia of the cylinders 16–22 during deceleration. The operator initiates the indexing process by actuating a reset mechanism of the controller 56.

The controller 56 controls the motor 24 to drive the cylinders 16–22 at the relatively high speed. The upper plate cylinder 16 is rotated (clockwise, as shown in FIGS 2 and 3) such that the target 66 is rotated toward the sensor field 78. As the upper plate cylinder 16 is rotated at the relatively high speed, the sensor field 78 is not aligned with any portion of the target 66 and not aligned with any portion of the sector of the upper plate cylinder 16. The signal provided by the sensor 68 remains at the first, unexcited level.

As the first edge 74 of the target 66 is rotated into alignment with the sensor field 78, the sensor 68 is excited and the signal provided by the sensor 68 steps up to its second, excited level. The controller 56, in response to the second, excited level of the signal from the sensor 68 controls the motor 24 to decrease the speed of the cylinders 16–22 to the relatively low speed. The motor 24 maintains this speed as the upper plate cylinder 16 rotates through a rotational segment which corresponds to the arc length of the target 66.

When the second edge 76 of the target 66 is rotated into alignment with the sensor field 78, the signal provided by the sensor 68 steps down to its first, unexcited level. In response to the change in the signal to the first, unexcited level, the controller 56 controls the motor 24 to cease operation. Only minimal inertial movement of the cylinders 16–22 after operation of the motor 24 stops may occur. The upper plate cylinder 16 and/or the upper blanket cylinder 18 are positioned such that the press operator can access the locking mechanisms 32 and 36 without excess wasted time and without risk of inertial overrun. If the positioning sequence is initiated with the sensor field 78 being aligned with any portion of the target 66, the motor 24 is controlled to only rotate the cylinders 16–22 at the relatively low speed until the second edge 76 is aligned with the sensor field 78. At the second edge 76, the motor 24 ceases operation, as before.

As an alternative mode of operation, the motor 24 is controlled to rotate the cylinders 16–22 in directions opposite to the directions shown in FIG. 1. During such opposite rotations, the second edge 76 is the leading edge, which is rotated toward the sensor field 78 first and which causes the signal from the sensor 68 to step up from the first, unexcited state to the second, excited state. Thus, upon a positioning maneuver for such opposite rotations, the upper plate cylinder 16 is rotated at a first, relatively high speed until the second edge 76 is aligned with the sensor field 78, and then rotated at a second, relatively low speed until the sensor field 78 is aligned with the first edge 74, at which time the motor 24 cease operation. The stopping positions of the cylinders 16–22 provided by such opposite rotations differ from the stopping positions obtained during a positioning maneuver with the cylinders 16–22 rotating in the directions shown in FIG. 1. The different stopping positions could be selected to be coincident with optimal cylinder cover (plate and/or blanket) removal and replacement positions, respectively.

As an alternative embodiment, another target (not shown) could be located on the axial end of the upper plate cylinder 16 to cause the signal from the sensor 68 to change for an additional stopping position. This additional stopping position could be selected to be coincident with an optimal removal or replacement position for one or some of the cylinders 16–22.

As another alternative embodiment, a second target 86 (FIG. 1) is positioned on an axial end of the lower plate cylinder 20 and a second sensor 88 is fixed to the frame for location adjacent to the axial end of the lower plate cylinder 20. A lead line 90 connects the second sensor 88 to the controller 56. A signal is produced by the second sensor 88 in a manner similar to the first sensor 68 and is usable to control operation of the motor 24 to position the lower plate cylinder 20 and the lower blanket cylinder 22 for servicing.

In the preferred embodiment, the sensor 68 controls the forward movement direction of cylinders 16 and 20. The sensor 88 controls the reverse movement direction of cylinders 16 and 20. This allows independent positioning in both forward and reverse directions which are not dependent on target length. The motor 24 and the controller 56 could also be dedicated to the plating or blanket change function and not used to print.

From the above description of the invention, those skilled in the art will perceive improvements, changes and modifications. Such improvements, changes and modifications within the skill of the art are intended to be covered by the appended claims.

Having described the invention, the following is claimed:

1. A method of positioning a rotatable printing cylinder, comprising:

driving the cylinder to rotate at a relatively high rate of speed when a sensor is not aligned with any portion of a segment between a first target edge and a second target edge and until the sensor is aligned with the first target edge;

driving the cylinder to rotate at a relatively low rate of speed when the sensor is aligned with the segment between the first and second target edges; and ceasing rotation of the cylinder when the sensor is aligned with the second target edge to position the cylinder.

2. A method as set forth in claim 1, including sensing the first target edge with the sensor and sensing the second target edge with the sensor.

3. A method as set forth in claim 1, including exciting the sensor as the sensor moves along the length of the target.

4. A method as set forth in claim 1, wherein said step of driving the cylinder at a relatively high rate of speed includes driving the cylinder at a speed approximately 15 times greater than the relatively low speed.

5. A method as set forth in claim 1, wherein said step of ceasing rotation of the cylinder includes stopping the cylinder at a location for servicing a printing cylinder cover.

6. A method as set forth in claim 1, wherein the location for servicing provides access to an edge of the printing cylinder cover.

7. A rotatable printing cylinder positioning device, comprising:

drive means for rotating the cylinder about a cylinder axis at a relatively high speed and for rotating the cylinder about the cylinder axis at a relatively low speed;

sensor means for detecting rotational positions of the cylinder and for providing a signal which varies in response to detected rotational positions of the cylinder;

target means for exciting said sensor means; and control means for controlling said drive means in response to the signal from said sensor means including means for controlling said drive means to rotate the cylinder at the relatively high speed until the cylinder reaches a first rotational position, for controlling said drive means to rotate the cylinder at the relatively low speed from the first rotational position to a second rotational position, and for controlling said drive means to cease rotation of the cylinder when the cylinder is at the second rotational position.

8. A device as set forth in claim 7, wherein said target means has first and second edges located at first and second ends, respectively, of a sector of the cylinder, said sensor means being aligned with said first edge of said target means and the first end of the sector at the first rotational position of the cylinder and being aligned with said second edge of said target means and the second end of the sector at the second rotational position of the cylinder, said drive means rotating the cylinder toward the first rotational position at the relatively high speed when said sensor means is not aligned with a point on the sector and said drive means rotating the cylinder from the first rotational position toward the sensor rotational position at the relatively low speed when said sensor means is aligned with a point on the sector.

9. A device as set forth in claim 8, wherein said target means extends along the sector of the cylinder.

10. A device as set forth in claim 7, wherein said sensor means and said target means are first sensor means and first target means, said device further including a second sensor means for detecting rotational positions of the cylinder and for providing a signal which varies in response to detected rotational positions of the cylinder, and a second target means for exciting said second sensor, said control means controlling said drive means in response to the signal from said second sensor means including means for controlling said drive means to rotate the cylinder at the relatively high speed until the cylinder reaches a third rotational position, for controlling said drive means to rotate the cylinder at the relatively low speed from the third rotational position to a fourth rotational position, and for controlling said drive means to cease rotation of the cylinder when the cylinder is at the fourth rotational position.

11. A device as set forth in claim 10, wherein said control means utilizes the signal from said first sensor means for rotation of the cylinder in a first direction and said control means utilizes the signal from said second sensor means for rotation of the cylinder in a second direction, opposite the first direction.

12. A device as set forth in claim 7, wherein the cylinder is a printing plate cylinder and carries a printing plate.

13. A device as set forth in claim 7, wherein the cylinder is a printing blanket cylinder and carries a printing blanket.

14. A device as set forth in claim 7, wherein the relatively high speed is approximately 15 times greater than the relatively low speed.

15. A device as set forth in claim 7, wherein the cylinder has an end face, said target means includes a strip of target material which extends in an arc on said end face.

16. A device as set forth in claim 7, wherein said sensor means includes an optical sensor and said target means includes an optical target.

17. A device as set forth in claim 7, wherein said sensor means includes a proximity sensor and said target includes a ferrous metal target.

18. A device as set forth in claim 7, wherein the cylinder is also rotatable in a second, opposite direction about the cylinder axis, said drive means includes means for rotating the cylinder in the second direction at a relatively high speed and at a relatively low speed, said control means includes means for controlling said drive means to rotate the cylinder in the second direction at the relatively high speed when said sensor means is not aligned with a point on the sector and until the cylinder reaches the second rotational position, for controlling said drive means to rotate the cylinder at the relatively low speed when said sensor means is aligned with a point on the sector and until the cylinder is at the first rotational position and for controlling said drive means to cease rotation of the cylinder when the cylinder is at the first rotational position.

19. A device as set forth in claim 7, wherein said device controls positioning of a second printing cylinder which is rotatable about a second cylinder axis, said device further includes a second sensor means positioned adjacent to the second cylinder for detecting rotational positions of the second cylinder and for providing a second signal which varies in response to detected rotational positions of the second cylinder and a second target means for exciting said second sensor means, said second target means having first and second edges located at first and second ends of a sector of the second cylinder, said second sensor means being aligned with said first edge of said second target means and the first end of the sector at a first rotational position of the second cylinder and being aligned with said second edge of said second target means and the second end of the sector at a second rotational position of the second cylinder, said drive means includes means for rotating the second cylinder about the second cylinder axis at a relatively high speed and for rotating the second cylinder about the second cylinder axis at a relatively low speed, said control means includes means for controlling said drive means in response to the second signal from said second sensor means to rotate the second cylinder at the relatively high speed when said second sensor means is not aligned with a point on the sector of the second cylinder and until the second cylinder reaches the first rotational position of the second cylinder, for controlling said drive means to rotate the second cylinder at the relatively low speed when said second sensor means is aligned with a point on the sector of the second cylinder and until the second cylinder is at the second rotational position of the second cylinder, and for controlling said drive means to cease rotation of the second cylinder when the second cylinder is at the second rotational position of the second cylinder.

20. A rotatable printing cylinder positioning device, comprising:

drive means for rotating the cylinder about a cylinder axis at a relatively high speed and for rotating the cylinder about the cylinder axis at a relatively low speed;

sensor means for detecting rotational positions of the cylinder and for providing a signal which varies in response to detected rotational positions of the cylinder;

target means for exciting said sensor means, said target means having first and second edges spaced along a segment of the cylinder, said sensor means being aligned with said first edge of said target means at a first rotational position of the cylinder and being aligned with said second edge of said target means at a second rotational position of the cylinder, the cylinder being rotatable through a rotational segment between the first and second positions; and control means for controlling said drive means in response to the signal from said sensor means including means for controlling said drive means to rotate the cylinder at the relatively high speed when the cylinder is not at a position on the rotational segment and until the cylinder reaches the first rotational position, for controlling said drive means to rotate the cylinder at the relatively low speed when the cylinder is located at a position on the rotational segment and until the cylinder is at the second rotational position, and for controlling said drive means to cease rotation of the cylinder when the cylinder is at the second rotational position.

* * * * *

UNITED STATES PATENT AND TRADEMARK OFFICE

CERTIFICATE OF CORRECTION

PATENT NO. : 5,492,062

DATED : February 20, 1996

INVENTOR(S) : Craig S. Harris, Glenn A. Guaraldi and Bertrum S. Ramsay

It is certified that error appears in the above-indentified patent and that said Letters Patent is hereby corrected as shown below:

Column 6, line 41, change "1" to --5--.

Signed and Sealed this

Twentieth Day of August, 1996

*Attest:*

*Attesting Officer*

BRUCE LEHMAN

*Commissioner of Patents and Trademarks*